US006840578B1

(12) United States Patent
Su

(10) Patent No.: US 6,840,578 B1
(45) Date of Patent: Jan. 11, 2005

(54) CHAIR IMPROVEMENT STRUCTURE

(76) Inventor: Wen-Fa Su, No. 42, Hsing Ya Rd., Chia Yi (TW)

( * ) Notice: Subject to any disclaimer, the term of this patent is extended or adjusted under 35 U.S.C. 154(b) by 0 days.

(21) Appl. No.: 10/662,290

(22) Filed: Sep. 16, 2003

(51) Int. Cl.[7] ..... A47C 1/02; A47C 1/024

(52) U.S. Cl. ..... 297/302.3; 297/302.1; 297/300.1; 297/300.2; 297/300.4; 297/313; 297/316; 297/325

(58) Field of Search ..... 297/300.2, 300.4, 297/302.1, 302.3, 300.1, 313, 325, 316

(56) References Cited

U.S. PATENT DOCUMENTS 4,763,950 A * 8/1988 Tobler ..... 297/300.3
5,810,439 A * 9/1998 Roslund, Jr. ..... 297/300.4
6,523,897 B2 * 2/2003 Pan ..... 297/302.1
6,582,019 B2 * 6/2003 Insalaco et al. ..... 297/300.4
6,588,844 B1 * 7/2003 Stenzel ..... 297/300.2
2002/0190556 A1 * 12/2002 Wilkerson et al. ..... 297/300.4

* cited by examiner

*Primary Examiner*—Peter M. Cuomo
*Assistant Examiner*—Sarah C. Burnham
(74) *Attorney, Agent, or Firm*—Rosenberg, Klein & Lee

(57) ABSTRACT

A chair has a seat connected to a support leg in an up and down angularly displaceable manner, elastic elements for propping up a rear end of the seat to a higher position, and a mechanism for limiting position of the seat when the seat seats people; the mechanism has an adjustment rod, a gear turnable together with the adjustment rod, an elastic plate for engaging the gear so as to prevent rotation of the gear when the adjustment rod isn't operated, and eccentric cams for holding the seat at desired position when the chair seats people; the cams can turn together with the adjustment rod, and are each formed with a stopping edge having several sections; thus, the depressed position of the seat, i.e. the position when the seat seats people, is decided by the position of the cams, and the seat can move accordingly when the sitter leans forwards.

1 Claim, 5 Drawing Sheets

CHAIR IMPROVEMENT STRUCTURE

BACKGROUND OF THE INVENTION

1. Field of the Invention

The present invention relates to a chair, more particularly one, which has a seat capable of being easily adjusted in respect of the seating depressed position to suit the sitters' need, and capable of changing position accordingly when the sitter leans forwards.

2. Brief Description of the Prior Art

There are many kinds of chairs. Among them, there is the kind of office chairs, which have a seat, and a single leg for supporting the seat. Early chairs of this kind can't be adjusted in the position of the seat therefore they are not comfortable to sit on. Therefore, chairs are provided, which have seats adjustable to suit the sitters' need.

However, seats of such chairs are fixed in position after they have been adjusted. Therefore, the seat can't change position accordingly when the sitter leans forwards, and one won't feel comfortable while she first comes into contact with the seat of the chair to sit down.

SUMMARY OF THE INVENTION

It is a main object of the present invention to provide a chair that will overcome the above disadvantages.

The chair of the present invention has a seat connected to a support leg in an up and down angularly displaceable manner, elastic elements for propping up a rear end of the seat to a higher position, and a mechanism for limiting the position of the seat when the seat seats people. The mechanism has an adjustment rod, a gear capable of turning together with the adjustment rod, an elastic plate for engaging the gear so as to prevent accidental rotation of the gear without operation of the adjustment rod, and several eccentric cams for holding the seat at a desired position when the chair seats people. The cams can turn together with the adjustment rod, and are each formed with a stopping edge comprised several stopping sections of different orientations; thus, the seating position of the seat, i.e. the position when the seat seats people, is decided by position of the cams.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
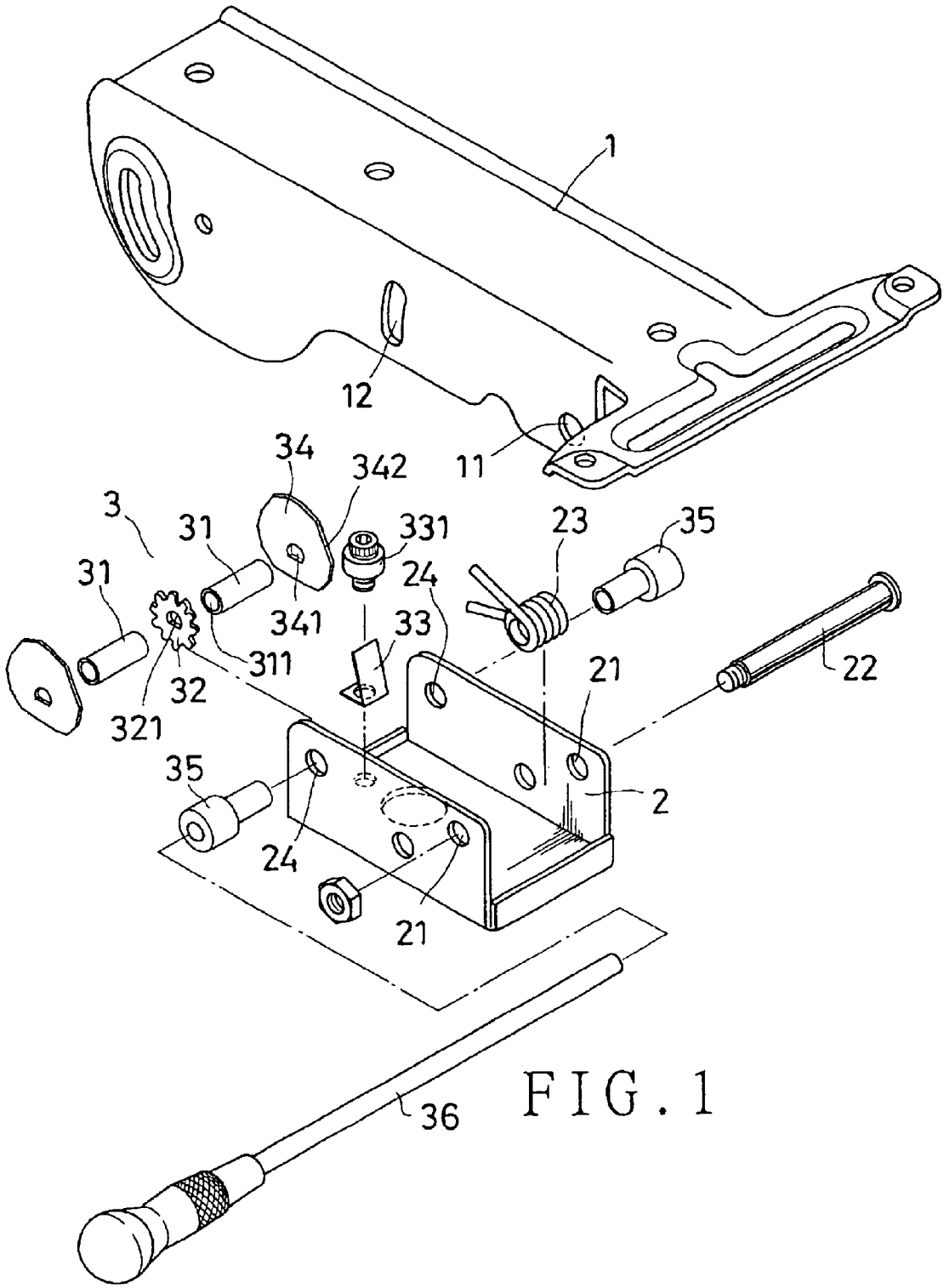
FIG. 1 is a partial exploded perspective view of the chair according to the present invention.
Figure 2:
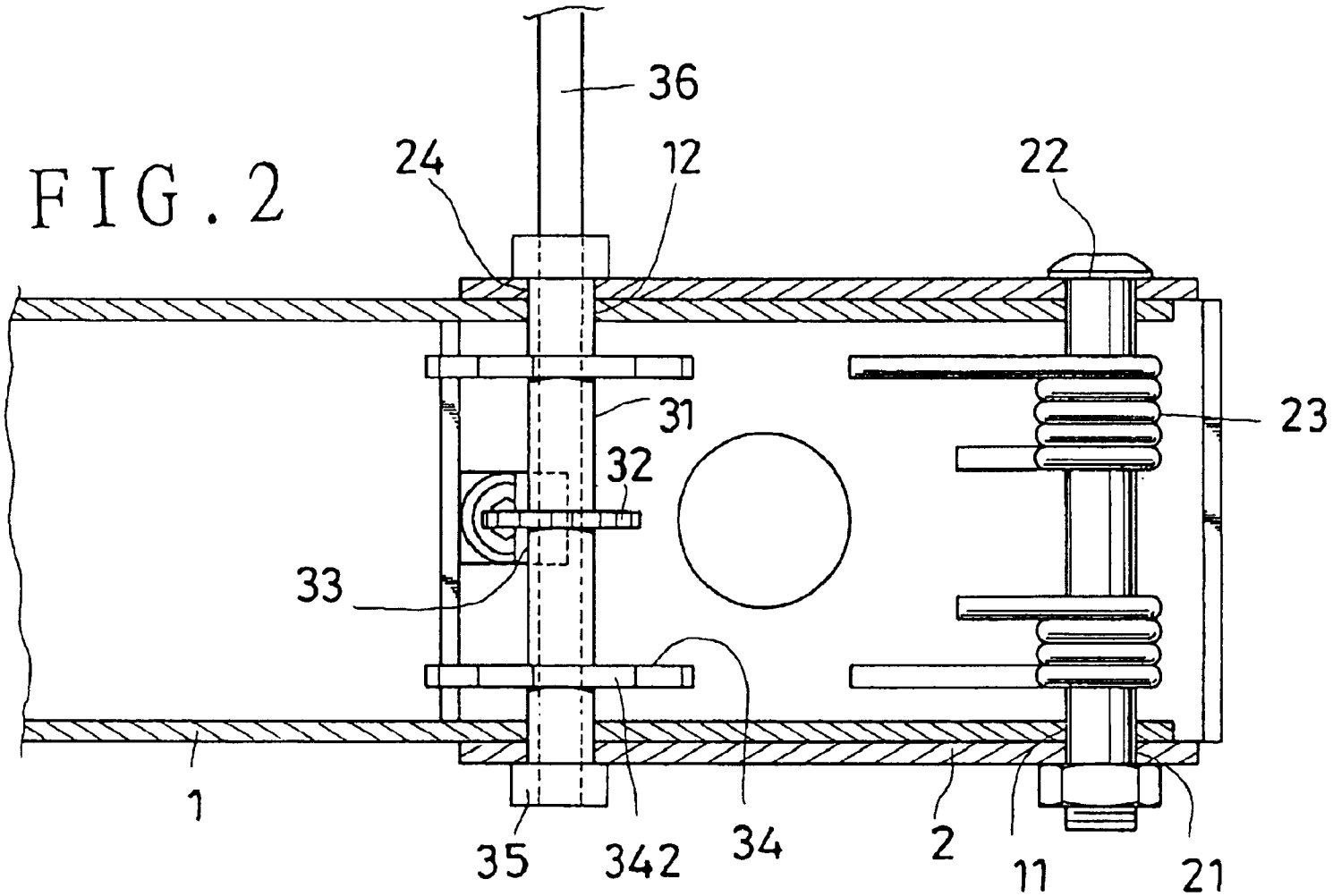
FIG. 2 is a partial cross-sectional view of the chair according to the present invention.
Figure 3:
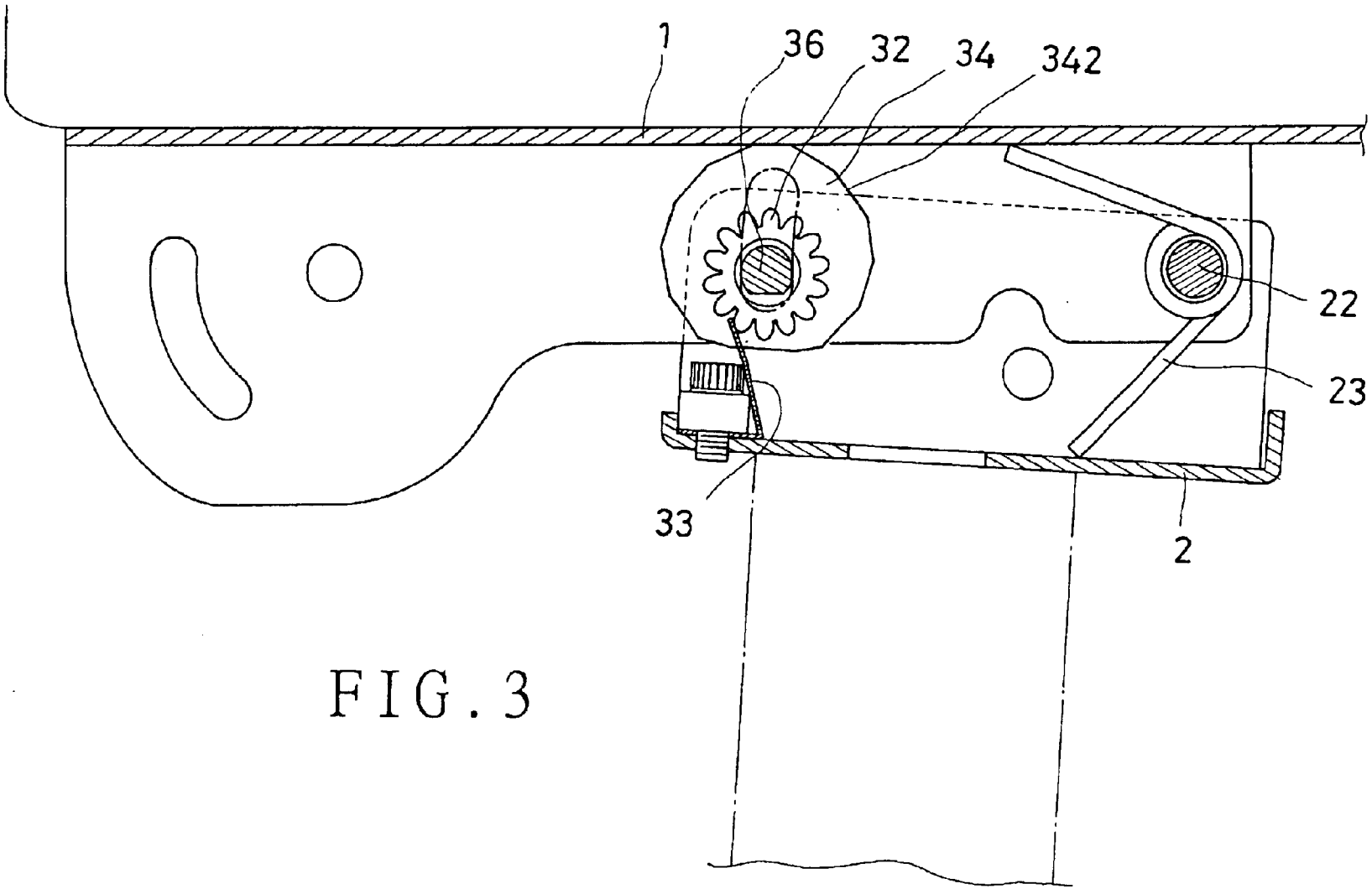
FIG. 3 is a partial vertical section of the chair of the present invention in use (1)
Figure 4:
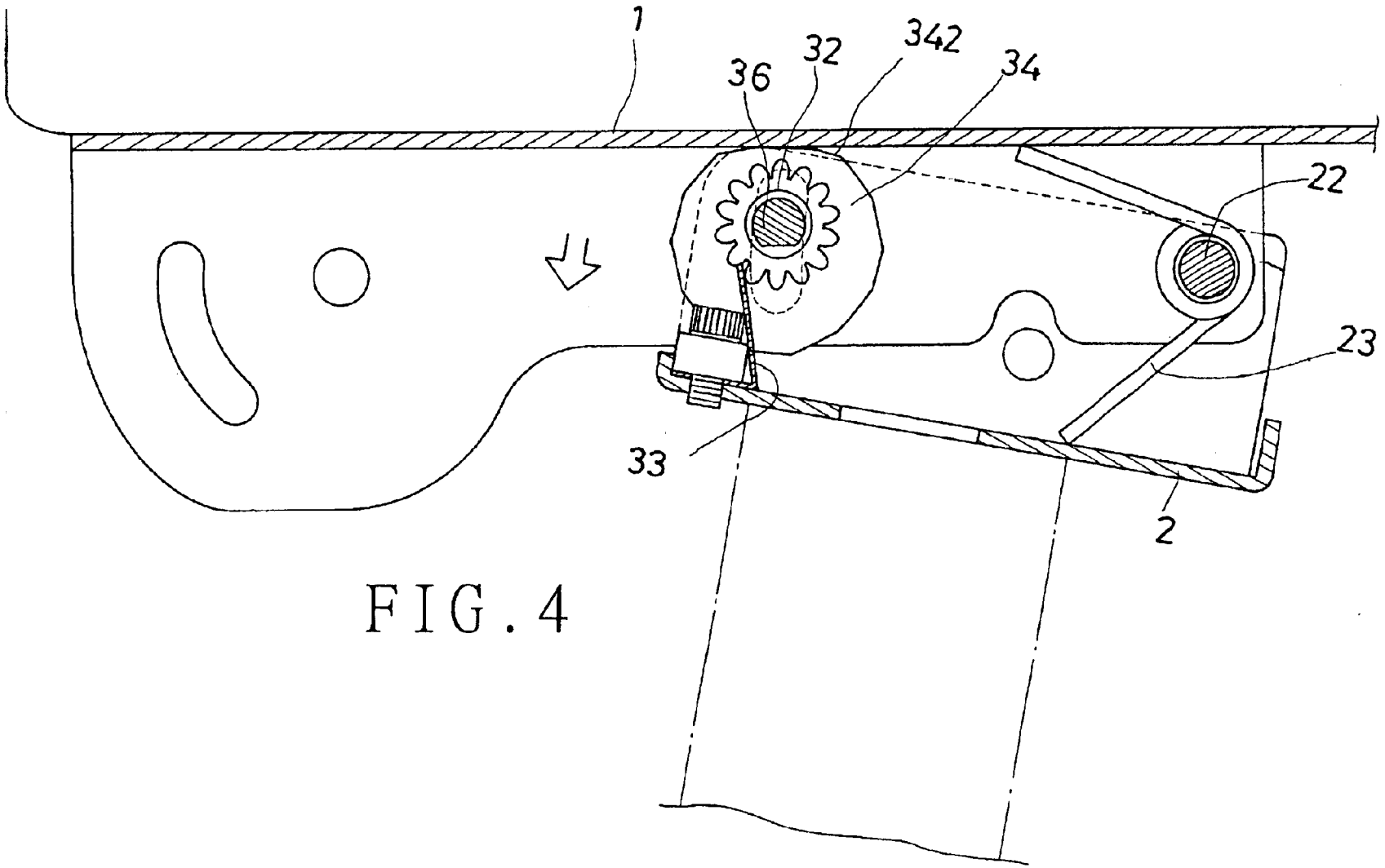
FIG. 4 is a partial vertical section of the chair of the present invention in use (2)
Figure 5:
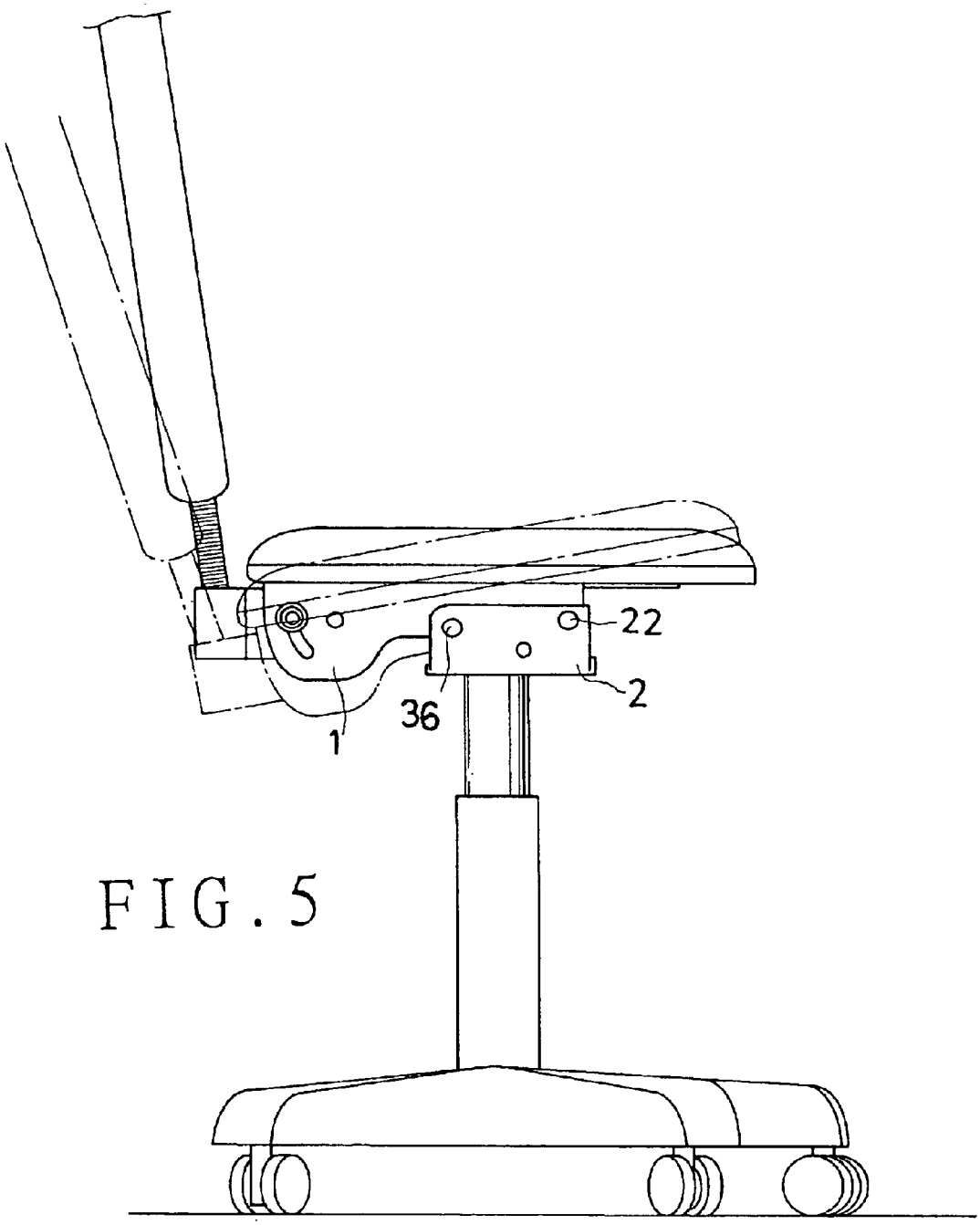
FIG. 5 is a partial side view of the chair of the present invention in use.

Referring to FIG. 1, a preferred embodiment of a chair in the present invention includes a movable support 1, a stationary support 2, and a position limiting mechanism 3.

The movable support 1 is fixedly connected to a lower side of a seat of the chair. The movable support 1 has an upper portion, and two lateral portions, which extend downwards from the upper portion; the lateral portions are parallel to each other, and have opposing pivotal holes 11 on front end portions, and opposing slots 12 near to middle portions thereof.

The stationary support 2 is fixedly connected to a top of a main support leg of the chair at a lower side, and has a lower portion, and two lateral portions extending upwards from the lower portion; the lateral portions are parallel to each other, and have opposing pivotal holes 21 on front end portions, and opposing through holes 24 on rear end portions.

The movable support 1 is connected to the stationary support 2 by means of a pivotal bolt 22, which is inserted through the pivotal holes 11 and 21 as well as several elastic elements 23 arranged between the lateral portions of the supports 1 and 2. Each elastic element 23 comes into contact with a downward side of the support 1, and an upward side of the support 2 at two ends respectively so that the rear end of the seat is normally at a higher position owing to the elastic elements 23, and will be at a lower position when one sits on the chair.

The position limiting mechanism 3 includes a gear 32, two tubes 31 connected with two sides of the gear 32 by welding, and two eccentric cams 34 connected with outward ends of respective ones of the tubes 31 by welding, an elastic plate 33, two holding blocks 35, and an axial adjustment rod 36. The gear 32 has a non-circular engaging hole 321, and the tubes 31 have axial holes 311, which oppose the engaging hole 321, and are bigger than the engaging hole 321. The eccentric cams 34 have engaging holes 341, which are away from the centers of the cams 34, and which have the same shape as the engaging hole 321 of the gear 32, and are positioned in the same way as the engaging hole 321. The elastic plate 33 is secured to the stationary support 2 substantially between the through holes 24 by means of a fixing element 331. Each eccentric cam 34 has a stopping edge 342 comprised of several stopping sections of different orientations. The axial adjustment rod 36 has a cross-section having the same shape as the engaging holes 321, 341. Each holding block 35 has an axial hole (not numbed).

The gear 32, the tubes 21, and the cams 34 are arranged between the lateral portions of the supports 1 and 2 with the gear 32 engaging the elastic plate 33, and with the holes 341 opposing the through holes 24 and the slots 12. And, the holding blocks 35 are inserted in respective through holes 24. The axial adjustment rod 36 is inserted in the axial holes of the holding blocks 35, and the holes 341, 411, 321 of the cams 34, the tubes 31, and the gear 32 so that the gear 32 and the cams 34 can be turned by means of the axial adjustment rod 36. Therefore, the cams 34 can be changed in position for making a selected one of the stopping sections of the stopping edge 342 face the upper portion of the movable support 1.

The rear end of the seat is normally at a higher position owing to the elastic elements 23 in case there is no one seated on the chair. And, when one sits on the chair, the elastic elements 23 are compressed, and the movable support 1 is at a lower position, in contact with the stopping edge 342 of the cams 34. Therefore, the seating position of the seat, i.e. the position when the seat seats people, is decided by the position of the cams 34, and one can easily change the position of the cams 34 by means of the axial adjustment rod 36; the elastic plate 33 will engage the gear 32 so that the cams 34 are prevented from accidentally turning to an undesirable position in case the adjustment rod isn't operated.

From the above description, it can be easily understood that the chair of the present invention can be easily adjusted to suit the sitters' need, and one will feel more comfortable while she first comes into contact with the seat to sit down owing to the elastic elements 23. And, the seat is allowed to change position accordingly when the sitter leans forwards.

What is claimed is:

1. An inclining chair structure, comprising a stationary support fixed to a top of a main support leg of a chair;

a movable support fixed to a lower side of a seat, the movable support being connected with a front end of the stationary support in an angularly displaceable manner at a front end thereof; elastic elements being connected with both of the supports for propping up a rear end of the seat to a higher position, and a mechanism for limiting position of the movable support as well as the seat; the mechanism having an adjustment rod inserted into slots of the movable support as well as holes of the stationary support to be operated in angularly displaceable manner by a user; the mechanism having a gear arranged between an upward side of the stationary support and a downward side of the movable support and turnable together with the adjustment rod; an elastic plate being secured to the upward side of the stationary support to engage the gear to prevent accidental rotation of the gear when the adjustment rod is not actuated; the mechanism having a plurality of eccentric cams arranged next to the gear and turnable together with the adjustment rod; each cam being formed with a stopping edge comprised of a plurality stopping sections for propping up the movable support as well as the seat when one is seated on the chair.

* * * * *